United States Patent [19]

Lutz

[11] Patent Number: 4,646,790

[45] Date of Patent: Mar. 3, 1987

[54] CUTTING MECHANISM FOR A WEAVING MACHINE

[75] Inventor: Friedrich Lutz, Durnten, Switzerland

[73] Assignee: Sulzer Brothers Limited, Winterthur, Switzerland

[21] Appl. No.: 814,096

[22] Filed: Dec. 27, 1985

[30] Foreign Application Priority Data

Jan. 10, 1985 [EP] European Pat. Off. ..... 85100206.3

[51] Int. Cl.[4] ..... D03D 47/34

[52] U.S. Cl. ..... 139/429; 139/450

[58] Field of Search ..... 139/429, 430, 450, 302, 139/303

[56] References Cited

U.S. PATENT DOCUMENTS

| | | | |
|---|---|---|---|
| 3,814,140 | 6/1974 | Serturini | 139/302 |
| 3,924,622 | 12/1975 | Budzyna | 139/302 |
| 4,194,537 | 3/1980 | Hodr et al. | 139/450 |
| 4,470,435 | 9/1984 | Lucian et al. | 139/429 |

*Primary Examiner*—Henry S. Jaudon
*Attorney, Agent, or Firm*—Kenyon & Kenyon

[57] ABSTRACT

The weaving machine comprises a reed and a cutting mechanism which is associated with the cloth edge on the picking side and which has a cutting element lowerable at the picking cadence from a neutral normal position above an imaginary prolongation of the beating-up line into a second operative position which is disposed approximately at the height of the beating-up line at a lateral distance from the movement zone of the reed and which is operative to guide the weft yarn to be severed. The cutting element is adjustable through the agency of an additional drive connection to move substantially parallel to the picking direction into a third operative position which is closer to the cloth edge laterally and which is disposed in the movement zone of the reed. In the third operative position, a second cutting element cooperates with the first cutting element to sever the weft yarn from the weft yarn supply at a very reduced distance from the cloth edge.

5 Claims, 7 Drawing Figures

CUTTING MECHANISM FOR A WEAVING MACHINE

This invention relates to a cutting mechanism for a weaving machine.

As is known, weaving machines have been provided with various types of cutting elements for cutting the ends of a weft yarn which has been picked into a shed. In some cases, the cutting mechanism has been positioned so as to sever a weft yarn after beating-up in a cloth. For example, Swiss Pat. No. 499,644 describes a weaving machine having a weft supply outside a shed, a reed for beating up one or more weft yarns picked into a shed onto a reed beating-up line and a pair of cutting elements associated with the cloth edge on the picking side. In addition, an actuating device is described as being coupled with a machine drive in order to drive at least one of the cutting elements at the picking cadence transverely of a weaving plane defined by the reed beating-up line and the cloth edge. In this regard, the cutting element is driven between a neutral first operative position spaced from the plane and a second position which is near the plane and which is operative to guide the weft yarn to be severed. Further, at least one of the cutting elements is movable relative to the other element in order to sever the picked weft yarn from the weft yarn supply.

However, when the cutting elements are in the neutral first position, i.e. the normal position, the cutting elements are retained above the pivoting zone of the reed. Thus, at each return of the reed, the cutting elements descend through the pivoting zone towards the weft yarn to be severed. If the cutting elements are not to contact the top of the reed during beating-up and subsequent return of the reed, the cutting elements must be mounted on guide members which have relatively long travels and a relatively long period of time must be allowed within the machining cycle. Further, this time becomes available only after the reed has returned from the adjustment or movement zone of the cutting elements.

Accordingly, it is an object of the invention to provide a weaving machine with a cutting mechanism in which cutting elements move through a small range of movement.

It is another object of the invention to provide a cutting mechanism for a weaving machine which is able to operate within a period of the machine cycle which covers beating-up and the start of a return movement of a reed.

It is another object of the invention to provide a cutting mechanism for cutting weft yarns close to a cloth edge.

Briefly, the invention provides a cutting mechanism for a weaving machine which includes a pair of cutting elements for severing a weft yarn beaten-up at a beating-up line. In accordance with the invention, the cutting mechanism employs an actuating device for moving the cutting elements transversely of the beating-up line between a first operative position, i.e. a position spaced from the path of movement of a reed, and a second operative position, that is, at the beating-up line, in order to receive a weft yarn extending from the beating-up line between the cutting elements. In addition, a drive connection is provided in the actuating device for moving the cutting elements parallel to to the beating-up line, i.e. transversely to the movement of the reed, so as to move between the second operative position and a third operative position adjacent a cloth edge at the beating-up position.

A means is also provided in the actuating device for moving the cutting elements relative to each other in the third operative position in order to sever a weft yarn therebetween.

In accordance with the invention, in both the first and second operative positions, the cutting elements are disposed at a lateral distance from the movement zone of the reed while in the third operative position, the cutting elements are brought laterally closer to the cloth edge and within the reed movement zone. The construction of the threading mechanism is such as to provide a very compact structure with components which can be designed for advantageously short travels of just a few millimeters, for example, 10 millimeters (mm), between the first and second operative positions of the cutting elements and between the second and third operative positions thereof. The construction of the cutting mechanism also allows the severing step, i.e., the lowering of the adjustable cutting element from the first operative position into a second operative position, to be initiated while beating up is still proceeding. Thus, the weft yarn to be cut off can be guided by the adjustable cutting element as early as the initial phase of the return movement of the reed and the cutting element can be moved into the position for severance associated with the third operative position.

It is a very simple matter to accurately adjust the guided cutting element from the side towards the cloth edge. For instance, by pressing the cutting element onto the edge warp yarns which are movable laterally in the zone of the reed beating-up line, a position for severance can be provided in which the cloth edge engages the cutting element so that all the weft yarn ends projecting from the cloth edge are severed substantially to the same length.

In order to provide a constructionally very simple and operationally reliable embodiment in which the actuating device is of particularly simple construction, the additional drive connection comprises a pivot shaft which is disposed transversely of the picking direction in a stationary mounting of the machine while the cutting elements are reciprocally pivotable around the pivot shaft between the second operative position and the third operative position.

One of the cutting elements may also be provided with a guide surface for the weft yarn to be severed which extends substantially parallel to the picking direction and which is formed with a cutting edge while a deflecting edge for the weft yarn is disposed transversely thereof. A cloth having advantageously short weft yarn ends projecting from the cloth edge can be provided if the deflecting edge is defined by a surface part of the cutting element remote from the shed which forms an obtuse angle with the guide surface of the cutting element. In this embodiment, the cutting-element part comprising the deflecting edge can be of trapezoidal cross-section designed in accordance with the required strength of the cutting element. In this case, the minor side of the cross-section forms the surface for guiding the weft yarn and determines the length of the end thereof projecting from the cloth edge while the major side of the cross-section, such side being remote from the weft yarn, can be selected in accordance with the required cross-sectional size.

Conveniently, the second operative position of the cutting elements is disposed between the reed movement zone and the movement zone of a guide element which is coupled with the reed, is positioned substantially upright at an appropriate lateral distance from the adjacent edge part of the reed and is intended to guide the weft yarn part to be engaged by the cutting element This allows that part of the weft yarn to be severed which is immediately adjacent the cloth edge to be retained substantially in the prolongation of the reed beating-up line. Thus, the adjustable cutting element can be lowered very near this line behind the weft yarn to be severed even while beating-up is proceeding, then during the subsequent return of the reed and the guide element the weft yarn can be released by the guide element, brought together with the cutting element and then severed.

These and other objects and advantages of the invention will become more apparent from the following detailed description taken alone or in combination wherein.

Figure 1:
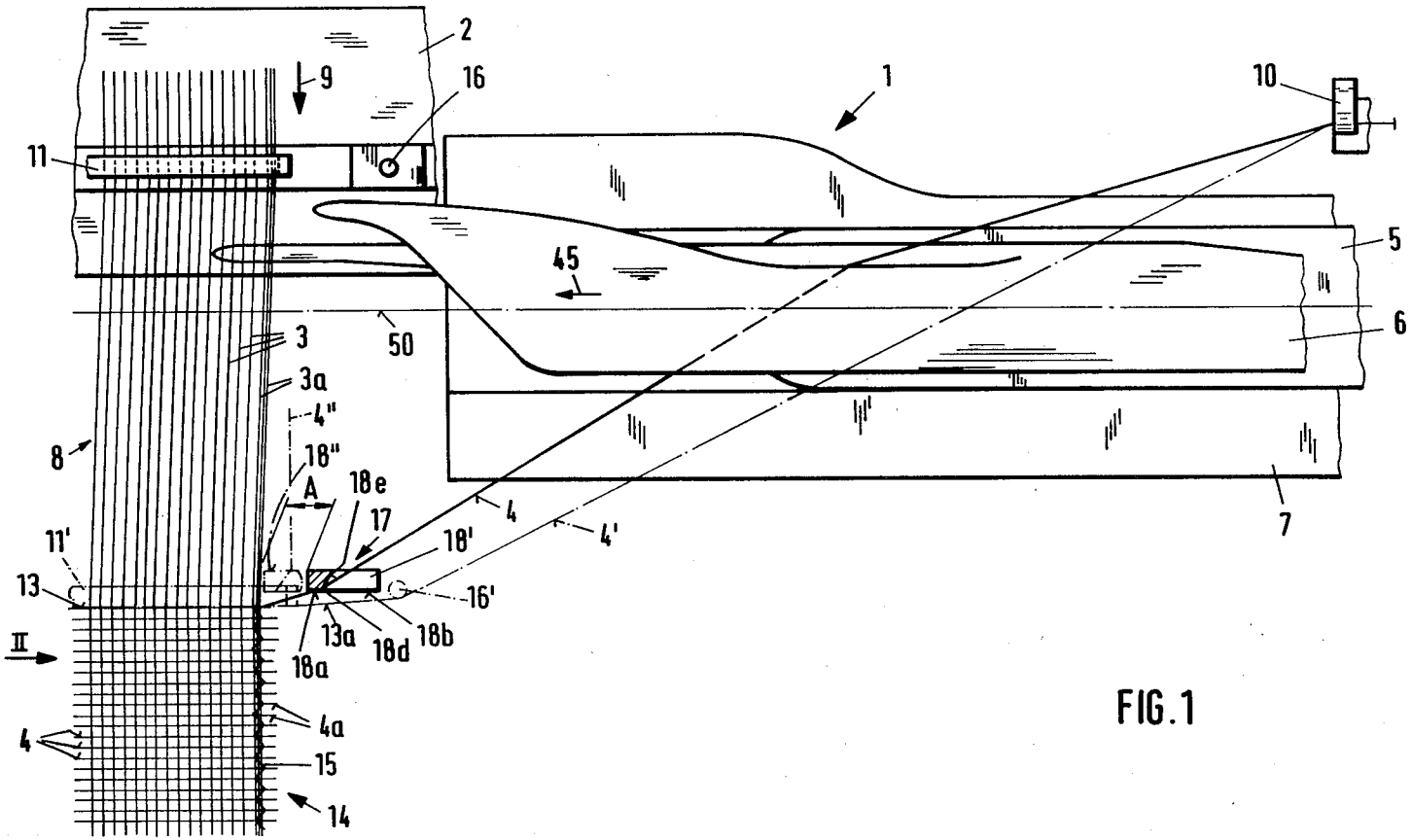
FIG. 1 illustrates a weft picking side of a gripper weaving machine employing a cutting mechanism in accordance with the invention, the view being in a partial plan view with a partial section on the line I—I of FIG. 3.

Referring to FIG. 1, the gripper weaving machine includes a picker 1 and a sley 2 for forming warp yarns 3 and weft yarns 4 into a cloth 14. The warp yarns 3 are paid off from the warp beam (not shown), pass through heddles (not shown) and dents 12 (FIG. 4) of a reed 11 disposed on the sley 2 and move in the direction indicated by an arrow 9 towards a cloth beam (not shown) which takes up the cloth.

The picker 1 comprises a bringer gripper 6 which is introduced by way of a belt or tape guide 7 into a shed 8 formed between the warp yarns 3. The gripper 6 can pick a weft yarn which comes from a supply bobbin (not shown) disposed outside the shed 8 and passes through an eye 10, which can be movable or stationary as shown in FIG. 1, into the shed 8. At the center of the shed 8, the tip of the weft yarn 4 is, in known manner, transferred to a taker gripper (not shown) which completes picking. The gripper 6 can pick a number of weft yarns simultaneously.

By way of the sley 2 which is coupled with the machine drive, the reed 11 can pivot between a rear position, shown in solid lines in FIG. 1, and a front position 11′ shown in chain-dotted lines, the weft yarn 4 most recently picked along a line 50′ being beaten up at the shed apex on a beating-up line 13 which is where cloth 14 begins. As shown in FIG. 1, the lateral edges 15 of the cloth 14 can each be embodied by appropriately controlled leno warp yarns 3*a*. A vertical guide pin 16 is disposed on the sley 2 in line with the reel 11 and can be guided towards the last weft yarn 4 to be picked. When in a front position 16′, the pin 16 retains the weft yarn 4 substantially in an imaginary prolongation 13*a* of the line 13. The reed 11 and pin 16 are spaced apart from one another by an amount such that a cutting element 18 of a cutting mechanism 17 associated with the cloth edge 15 can be introduced downwardly between the pivoting zones of the reed 11 and pin 16.

Referring to FIGS. 2–7, the cutting mechanism 17 has an actuating device 20 which actuates the cutting element 18 and which is coupled with the machine drive, and a cutting element 19 co-operating with the element 18. The device 20 comprises two bent levers 21, 22 disposed one beside another, and so as to be movable relative to one another, on a common pivot shaft 23 disposed transversely of the direction of warp yarn movement. The levers 21, 22 each have a support arm 21*a*, 22*a* respectively projecting beyond the prolongation 13*a* and a vertical adjusting arm 21*b*, 22*b* respectively. The cutting element 18 is screwed to that end of the arm 21*a* which projects beyond the prolongation 13*a*. The cutting element 19 is disposed on a spring strip 19*a* screwed to a holder 29 pivoted to the arm 22*a*. The spring strip 19*a* is biased by a compression spring 24 which bears on the lever 21 and which presses the element 19 on to a front guide surface 18*a* of the element 18, the latter surface being near the prolongation 13*a*.

The surface 18*a* comprises a cutting edge 18*b* which extends substantially parallel to the line 13 and which is formed on a substantially U-shaped guide notch 18*c* (FIG. 4) in the cutting element 18. As can be gathered from FIG. 4, the opening of the notch or incision 18*c* is disposed on that side of the cutting element 18 which is remote from the cloth edge 15. The bottom edge of the element 19 is devised as a cutting edge 19*b*.

The two levers 21, 22 are secured to one another by a compression spring 25 disposed between their arms 21*a* and 22*a*. In the operative positions shown in FIGS. 2–5, the arm 21*b* is pressed on to a striking head 22*c* of the lever 22 while the element 19 is retained above the incision 18*c*. Pivot shaft 23 of levers 21, 22 is secured in a holder 26 clamped to a pivot shaft 27 disposed transversely of the picking direction indicated by an arrow 45.

The pivot shaft 27 is mounted in a pivot bearing 28 screwed to a stationary part 30 of the machine. A striking lever 31 is secured for corotation by means of a clamping connection to the rear end of the pivot shaft 27, the latter end projecting from the holder 26. An abutment head 43 which is adjustable and locatable by means of an adjusting screw 42 is screwed to the free end of the lever 31, is adapted to co-operate with an abutment part 44 (FIG. 7) formed on the arm 21*b* and bounds the range of movement of the lever 21.

A pivot lever 32 is clampingly secured to the front end of the pivot shaft 27, such end projecting from the bearing 28, and co-operates with an adjusting ring 33 displaceably secured to the pivot shaft 27 to determine the axial position of the shaft 27 relative to the bearing 28 and, therefore, the corresponding position of the cutting mechanism 17 relative to the beating-up line 13.

Figure 6:
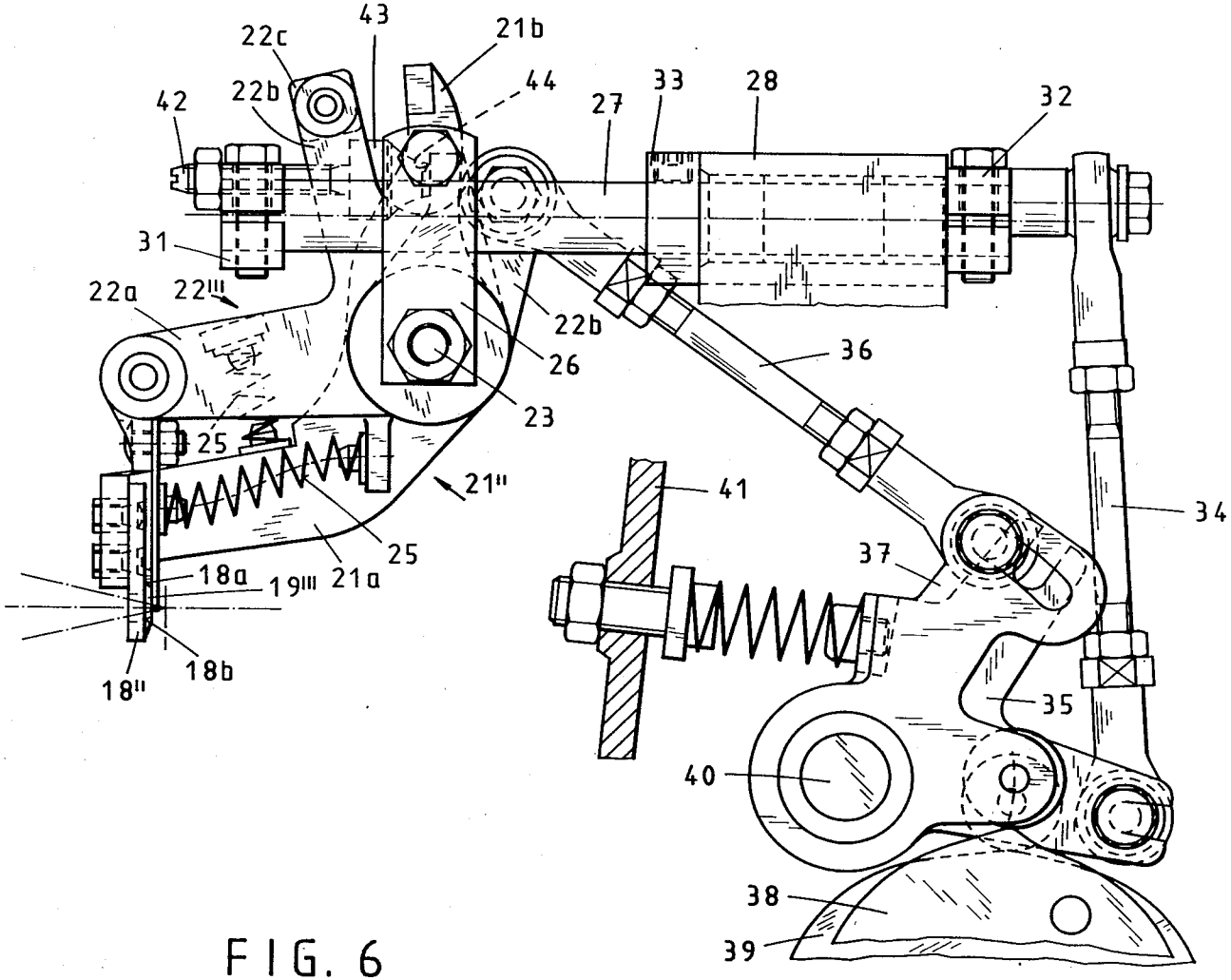
FIG. 6 illustrates the cutting mechanism in a fourth operative position, the view being in a side elevation corresponding to FIG. 3.

Referring to FIG. 6, an adjusting rod 34 is pivoted at one end to the lever 32; the other end of the rod 34 is pivoted to a cam follower lever 35. A corresponding rod 36 is pivoted to the arm 22*b* of lever 22 and a cam follower lever 37. The levers 35, 37 are pivotable around a shaft 40, bear resiliently on a part 41 of the machine and co-operate with cams 38, 39 disposed on a drive shaft (not shown) coupled with the machine drive Ball joints permitting three-dimensional adjusting movements are provided at the articulations of the rods 34, 36.

Figure 2:
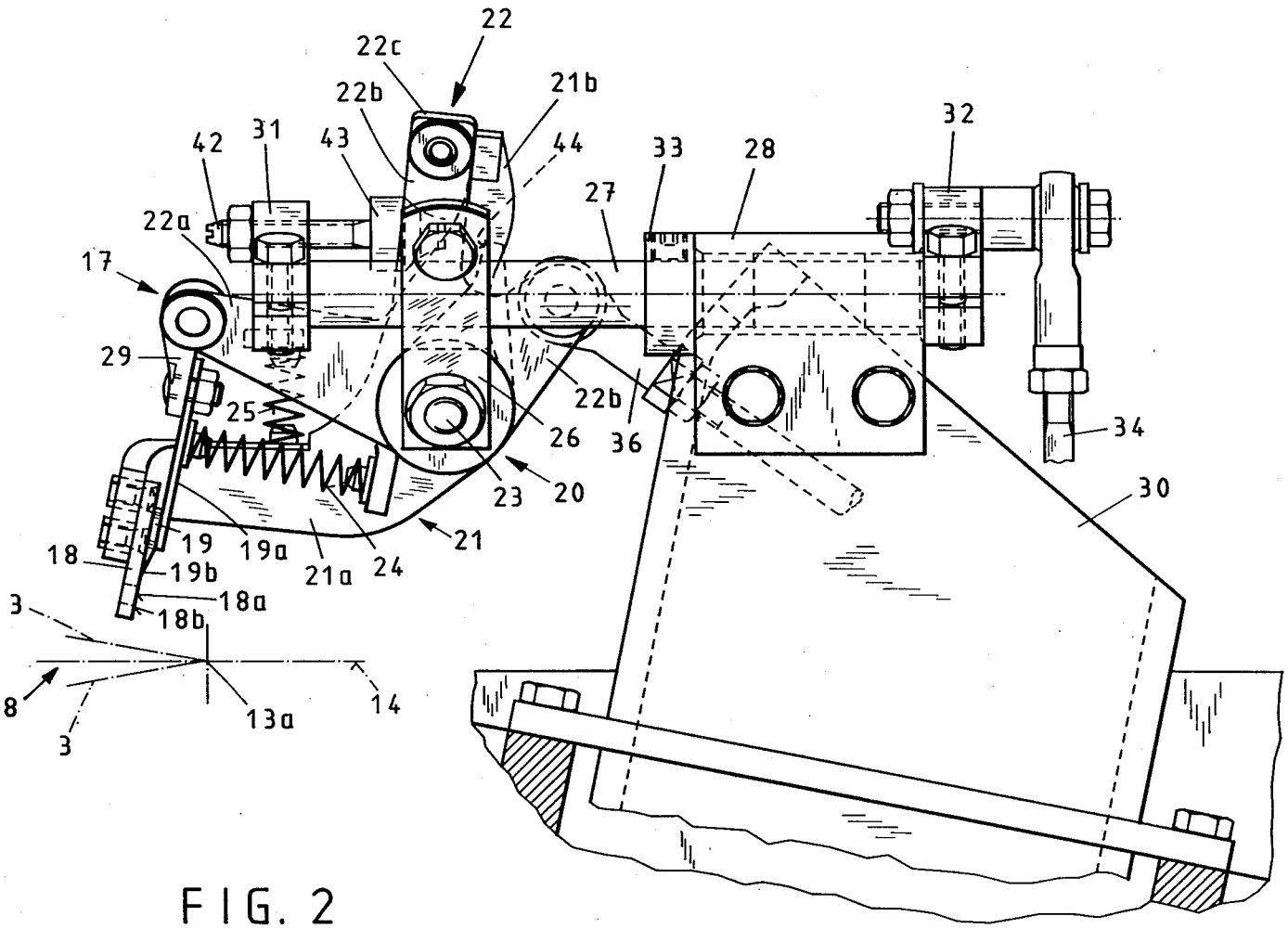
FIG. 2 illustrates a cutting mechanism of the invention in a neutral first operative position, the view being in side elevation as indicated by an arrow II in FIG. 1.
Figure 3:
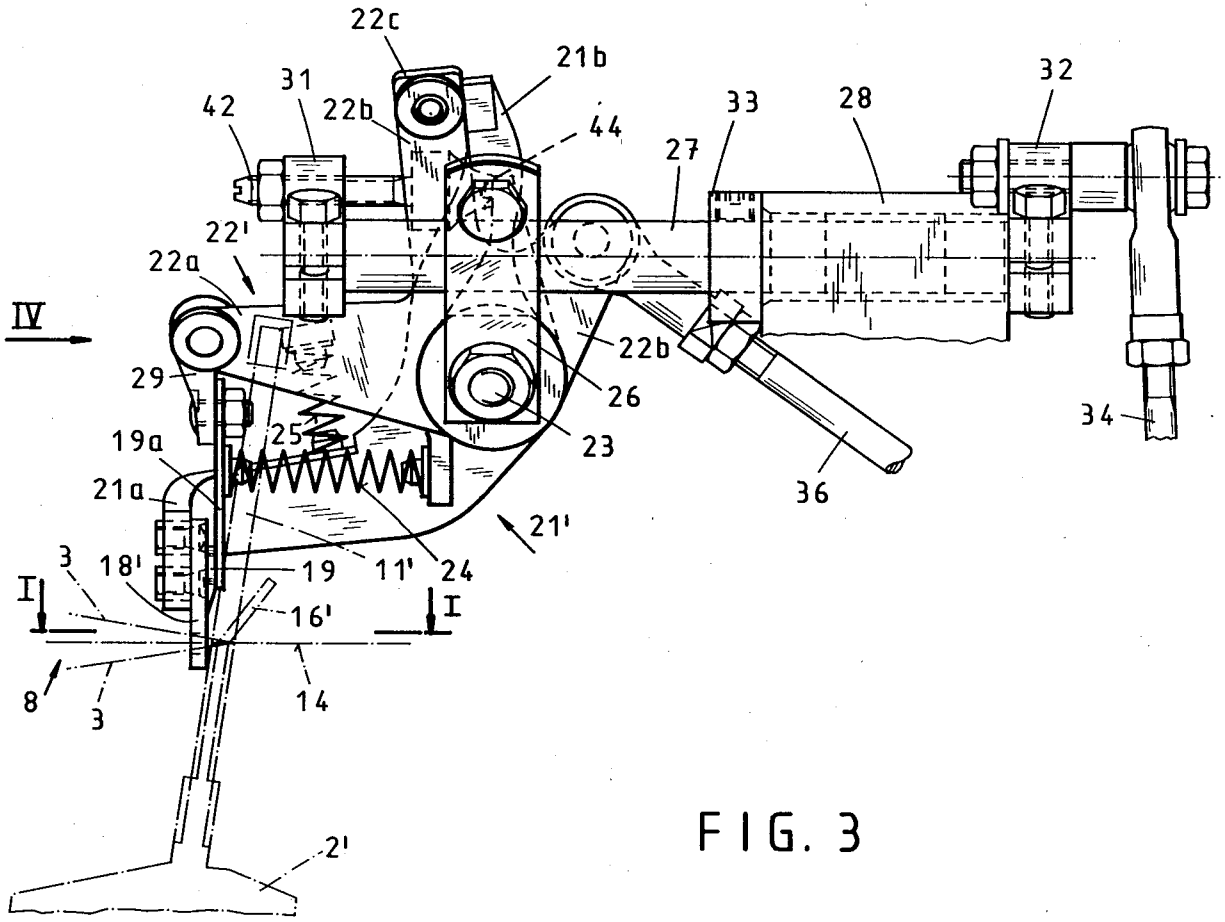
FIG. 3 illustrates the mechanism of FIG. 2 in a second operative position.
Figure 4:
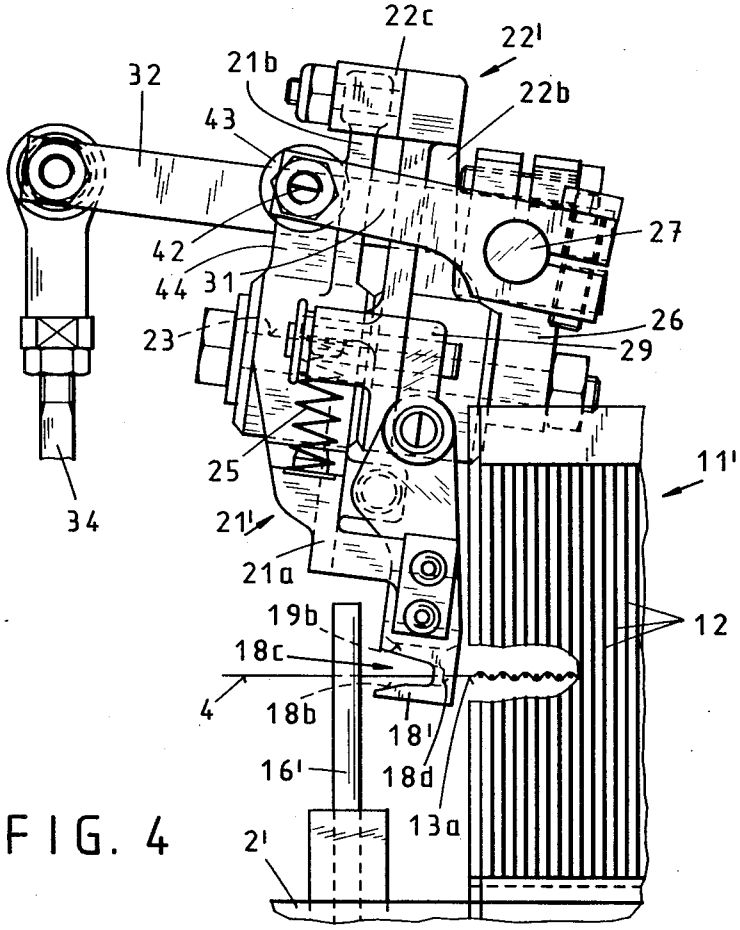
FIG. 4 illustrates the cutting mechanism in the operative position of FIG. 3, the view being in a front elevation in the direction indicated by an arrow IV of FIG. 3.

By appropriate adjustment of the holder 26, lever 32 and rods 34, 36, the levers 21, 22 are disposed in an inclined position in which, in the operative positions shown in FIGS. 2 and 3, their common pivot shaft 23 is at an inclination to the horizontal as shown in FIG. 4. Through the agency of the rod 36 and in synchronism with the drive of the picker 1, the levers 21, 22 pressed onto one another on the head 22*c* are pivoted during each beating-up from the position shown in FIG. 2 into the position 21', 22' shown in FIGS. 3 and 4, the cutting element 18 descending from its neutral first operative position (normal position) above the beating-up line prolongation 13*a* into a second operative position 18' which is disposed after the prolongation 13*a* and in which the cutting edge 18*b* is disposed below the weft yarn 4 to be severed (FIGS. 1, 3 and 4). In FIG. 4 the front position (beating-up position) 11' and 16' of the reed 11 and pin 16 are shown in solid lines.

When the reed 11 and pin 16 return from beating up into the rear position indicated by solid lines in FIG. 1, the weft yarn 4 to be severed is moved towards the element 18, thus moving from the chainline position 4' in FIG. 1, in which the yarn 4 extends rectilinearly between the eye 10 and the pin 16 in a front position 16', into the solid-line position. The weft yarn 4 is simultaneously engaged by the gripper moving in the direction of the arrow 45 and is deflected on the cutting element 18 by means of a deflecting edge 18*d* which limits the depth of the incision 18*c* and into which the cutting edge 18*b* merges.

Referring to FIG. 1, the warp yarns 3, which are guided parallel to one another between the heddles (not shown) and the reed 11, converge towards the line 13 since because of the tension of the weft yarns 4 which have been connected with the warp yarns in the cloth-forming step, the distances between the warp yarns 3 are reduced. Therefore, the width of the cloth 14 is reduced correspondingly as compared with the width of the group of warp yarns guided near the reed 11. Because of this reduction of the cloth, the edge 15 takes up a position at a lateral distance A from the cutting element 18 which is in its second operative position. The distance A is greater than the distance which exists in this second operative position between the element 18 and the dent 12 which guides the adjacent edge warp yarn and which is associated with the reed 11 in its front position 11'.

Figure 5:
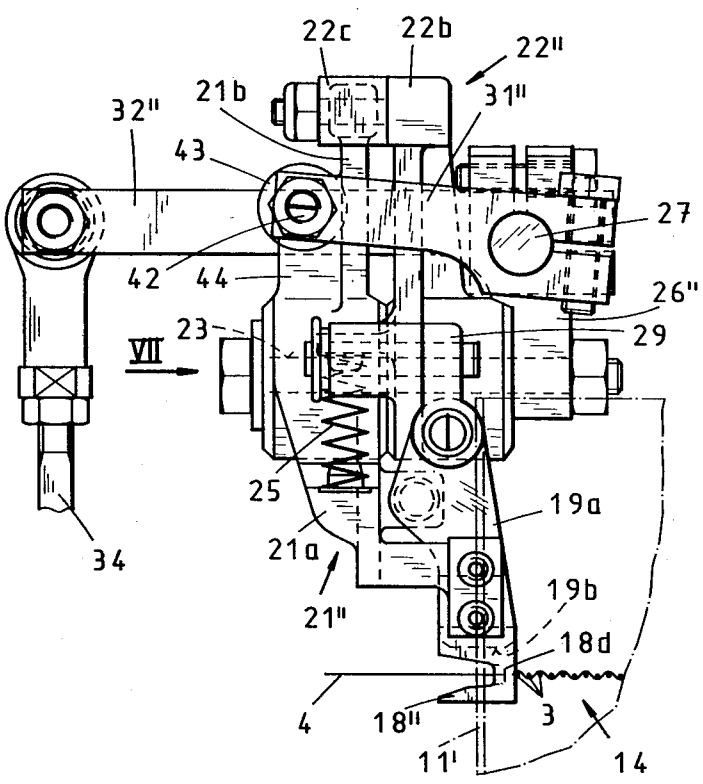
FIG. 5 illustrates the cutting mechanism in a third operative position in a front elevation corresponding to FIG. 4.

As the reed 11 continues to return, the pivot shaft 27 is pivoted counter-clockwise in FIG. 4 by way of the rod 34 and lever 32, so that the holder 26 and the lever 31 move into the positions 26'', 31'', respectively and the two levers 21, 22 which are in engagement, with one another on the head 22*c* move from the position 21', 22' of FIG. 3 and FIG. 4 into the position of FIG. 5 in which the pivot shaft 23 extends substantially parallel to the line 13. The cutting element 18 is thus pivoted inwards, substantially parallel to the line 13, into a third operative position 18'' inside the pivoting zone of the reed 11 and moves towards the bottom-most warp yarn 3.

Figure 7:
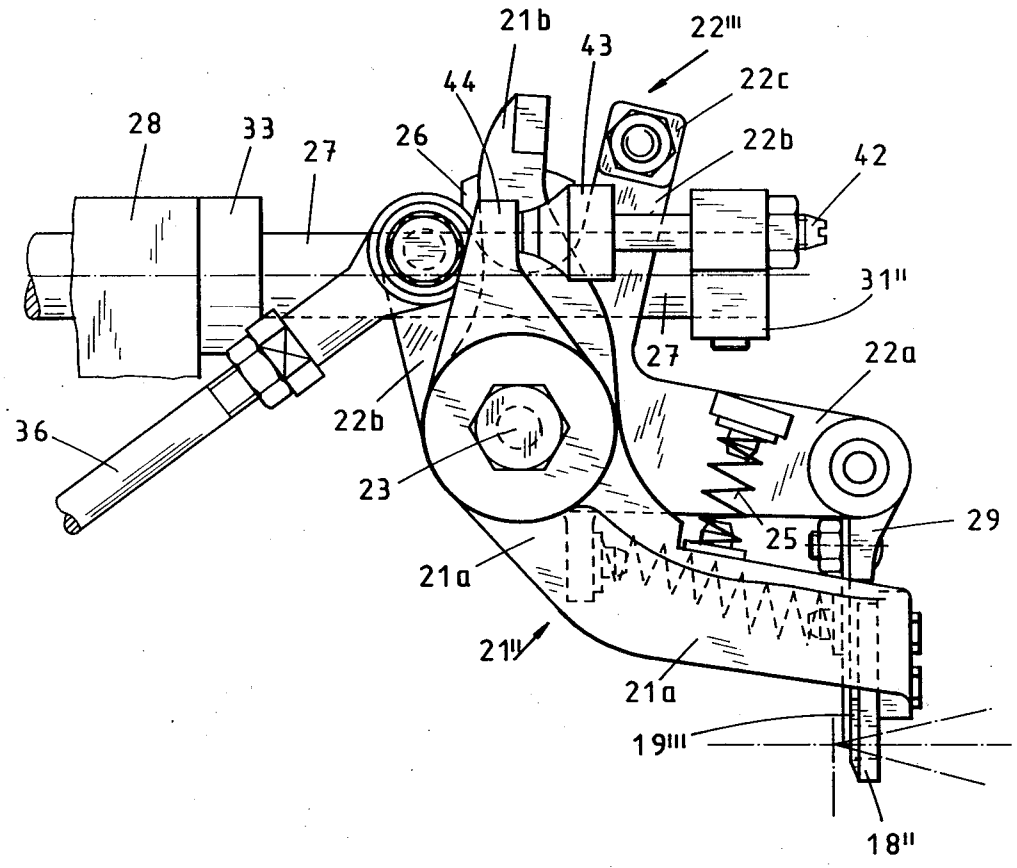
FIG. 7 illustrates a view taken on line VII of FIG. 5.

The picking movement of the gripper 6, then moves the weft yarn 4 towards the chain-dotted-line position 4'' of FIG. 1. The rod 36 simultaneously pivots the lever 22 around the horizontal shaft 23 into the position 22''' of FIGS. 6 and 7, appropriate adjustment of the head 43 which limits the pivoting zone of the arm 21*b* retaining the lever 21, the cutting element 18 substantially remaining in the position 18'' of FIG. 5. The head 22*c* disengages correspondingly from the arm 21*b* and the arm 22*a* descends relative to the arm 21*a* against the force of compression spring 25. Thus, the cutting element 19 is pushed along the guide surface 18*a* over the incision 18*c* and is guided by way of the cutting element into the position 19''' as indicated in FIG. 7. The weft yarn 4 which has previously been deflected on the edge 18*d* into the position 4'' moves towards the cutting edge 18*b* and is severed substantially at the place of deflection. Thereafter, the cutting elements 18, 19 return through the third and second operative positions to the normal position shown in FIG. 2.

The holder 26 which supports the pivot shaft 23 of the levers 21, 22 as well as the lever 31 are individually fastened to the pivot shaft 27. The lever 31 is also adjusted in such a way that the head 43 (see FIG. 7) fastened on the end defines the pivot range of the abutment part 44 on the lever 21. When the lever 22 is pivoted around the shaft 23, i.e. from the position illustrated in FIG. 2 to the position 22' of FIG. 3, the lever 21 which abuts on the lever 22 via the spring effect is guided with the part 44 against the head 43. During the following pivoting of the entire arrangement about the shaft 27, i.e. from the position of FIG. 4 to the position of FIG. 5, the levers 21, 22 remain together. During subsequent pivoting of the lever 22 around the shaft 23 into the position 22''' of FIG. 6, the lever 21 is held back in the position 21''' reached in FIG. 5. Correspondingly, the cutting element 19 is guided via the cutting edge 18*b* into the position 19''' according to FIG. 6 for the purpose of cutting off the weft yarn 4.

In the arrangement described, the length of the weft yarn ends 4*a* which project from the cloth edge 15 and which remain in the cloth 14 corresponds to the width, measured parallel to the line 13, of the guide surface part remaining near the deflecting edge 18*d*. As shown in FIG. 1, this surface part near the prolongation 13*a* of the line 13 can be very narrow if it includes an obtuse angle with the base surface 18*e* of the incision 18*c*, such surface forming the deflecting edge 18*d*, so that the cutting element 18 can have a trapezoidal cross-section near the incision 18*c*, such cross-section ensuring that the cutting element 18 has the necessary strength.

The cutting mechanism 17 can also be used for multi-weft weaving machines in which a number of weft yarns, for example three weft yarns, are picked into the shed in a random sequence, only the weft yarn which is required for the subsequent pick being transferred to the picking element and moved to be together with the element 18, while the weft yarns not participating in this pick and initially remaining in the cloth are retained by appropriately controlled guide elements at a distance from the operative zones of the picking element and of the cutting elements.

The cutting mechanism 14 described or a corresponding one can also be used for weaving machines having different picking systems, such as projectile weaving machines or drag shuttle weaving machines or weaving machines with fluid, for example pneumatic, picking. Also, variants of the cutting mechanism described, for example cutting mechanisms having scissors-like cutting elements, can be lowered and adapted to be moved towards the cloth edge from the side. The cutting elements can have cutting edges which extend transversely to the beating-up direction, for example parallel to the direction of weft yarn movement.

What is claimed is:

1. In a weaving machine, the combination comprising a reed for beating-up a weft yarn picked into a shed into a beating-up line, said reed being movable in a path between a rest position and a beating-up position at said beating-up line;

means for picking a weft yarn from a yarn supply into the shed;

a pair of cutting elements for severing a weft yarn beaten-up at said beating-up line;

an actuating device for moving said cutting elements longitudinally of the movement of said reed between a first operative position spaced from said path of said reed and a second operative position at said beating-up line to receive a weft yarn extending from said beating-up line between said cutters;

a drive connection in said actuating device for moving said cutting elements transversely to the movement of said reed between said second operative position and a third operative position adjacent a cloth edge at said beating-up position; and means in said actuating device for moving said cutting elements relative to each other in said third operative position to sever a weft yarn therebetween.

2. The combination as set forth in claim 1 wherein said drive connection includes a stationary mounting, a pivot shaft rotatably mounted in said mounting transversely of said beating-up line with said cutting elements mounted thereon for pivoting therewith and a pivoting means connected to said shaft to pivot said shaft and said cutting elements between said second and said third operating positions.

3. The combination as set forth in claim 1 wherein one of said cutting elements includes a guide surface for a weft yarn extending substantially parallel to said beating-up line in said second operative position, a cutting edge along said guide surface and a surface part perpendicular to said cutting edge and disposed at an obtuse angle with said guide surface to define a deflecting edge for a weft yarn.

4. A combination as set forth in claim 1 which further comprises a guide element coupled with said reed and disposed in spaced relation to said reed to guide a weft yarn extending from said reed to the yarn supply, said cutting elements being disposed between said reed and said guide element in said second operative position to engage a weft yarn therebetween.

5. A cutting mechanism for a weaving machine comprising a pair of cutting elements for severing a weft yarn beaten-up at a beating-up line;

an actuating device for moving said cutting elements transversely of said beating-up line between a first operative position and a second operative position to receive a weft yarn extending from said beating-up line between said cutting elements;

a drive connection in said actuating device for moving said cutting elements parallel to said beating-up line between said second operative position and a third operative position adjacent a cloth edge at said beating-up position; and means in said actuating device for moving said cutting elements relative to each other in said third operative position to sever a weft yarn therebetween.

* * * * *

UNITED STATES PATENT AND TRADEMARK OFFICE

CERTIFICATE OF CORRECTION

PATENT NO. : 4,646,790

DATED : March 3, 1987

INVENTOR(S) : Friedrich Lutz

It is certified that error appears in the above-identified patent and that said Letters Patent is hereby corrected as shown below:

Column 1, line 20 "transverely" should be -transversely-
Column 1, line 67 "to to" should be -to-
Column 3, lines 56 and 57 "movable or stationary as shown in Fig. 1," should be -movable or, as shown in Fig. 1, stationary-
Column 3, line 66 "50'" should be -50-
Column 5, line 62 "position of" should be -position 21", 22" of-
Column 6, line 13 "element" should be -element 18-

Signed and Sealed this

Twenty-ninth Day of September, 1987

*Attest:*

DONALD J. QUIGG

*Attesting Officer* *Commissioner of Patents and Trademarks*